US011999549B2

(12) United States Patent
Zou

(10) Patent No.: US 11,999,549 B2
(45) Date of Patent: Jun. 4, 2024

(54) SQUEEZE SLUSHY CUP CAPABLE OF REALIZING QUICK HEAT EXCHANGE FOR MAKING SLUSHY DRINKS

(71) Applicant: Haiyan Zou, Jiangxi (CN)

(72) Inventor: Haiyan Zou, Jiangxi (CN)

( * ) Notice: Subject to any disclaimer, the term of this patent is extended or adjusted under 35 U.S.C. 154(b) by 126 days.

(21) Appl. No.: 17/864,954

(22) Filed: Jul. 14, 2022

(65) Prior Publication Data

US 2024/0002125 A1 Jan. 4, 2024

Related U.S. Application Data

(63) Continuation of application No. PCT/CN2022/102352, filed on Jun. 29, 2022.

(51) Int. Cl.
*B65D 77/04* (2006.01)
*F25D 3/00* (2006.01)

(52) U.S. Cl.
CPC ..... *B65D 77/0493* (2013.01); *F25D 3/005* (2013.01)

(58) Field of Classification Search
CPC . B65D 77/0493; B65D 77/0486; F25D 3/005; F25D 3/08
USPC ..... 220/389, 574.2, 573.4, 495.03, 23.83, 220/23.91, 62.12; 62/457.1, 457.4, 297, 62/252; 165/73
See application file for complete search history.

(56) References Cited

U.S. PATENT DOCUMENTS

| | | | | |
|---|---|---|---|---|
| 3,205,677 | A * | 9/1965 | Stoner | A47G 19/2288 62/457.3 |
| 3,715,895 | A | 2/1973 | Devlin | |
| 4,528,824 | A | 7/1985 | Herbert | |
| 5,271,244 | A * | 12/1993 | Staggs | F25D 31/007 62/530 |
| 5,361,604 | A * | 11/1994 | Pier | B65D 81/3883 62/530 |
| 8,534,345 | B1 * | 9/2013 | French | A47J 41/0083 165/10 |
| 8,561,825 | B1 * | 10/2013 | Kino | B65D 81/3869 220/592.16 |
| 9,555,949 | B1 * | 1/2017 | French | F25D 3/08 |
| 10,123,552 | B2 | 11/2018 | Delle Coste | |
| 11,597,582 | B1 * | 3/2023 | French | F25D 3/08 |
| 2005/0252234 | A1 * | 11/2005 | Kim | F25D 27/00 62/464 |
| 2019/0093945 | A1 * | 3/2019 | Nguyen | F25D 3/08 |
| 2021/0113024 | A1 | 4/2021 | Barrie | |
| 2022/0022484 | A1 | 1/2022 | Van Isacker | |

* cited by examiner

*Primary Examiner* — Rafael A Ortiz

(57) ABSTRACT

The present invention provides a slushy cup capable of realizing quick heat exchange. The slushy cup capable of realizing quick heat exchange includes an inner core, an outer cup body, and a sealing connection sleeve sleeving the outer cup body, wherein the sealing connection sleeve stores a refrigerant in an interlayer in a sealing manner through multi-layer sealing, and convex ribs are distributed on an outer circumferential side wall of a main body portion of the inner core, thereby increasing a contact area of heat exchange and enhancing the strength of an outer wall of the inner core. Through full contact between the convex ribs on an outer surface of the inner core and the refrigerant, cold energy of the refrigerant in the interlayer is quickly conducted to a drink in the inner core to quickly cool the drink into a slushy drink.

16 Claims, 8 Drawing Sheets

SQUEEZE SLUSHY CUP CAPABLE OF REALIZING QUICK HEAT EXCHANGE FOR MAKING SLUSHY DRINKS

CROSS REFERENCE TO RELATED APPLICATION

This application is International Patent Application No. PCT/CN2022/102352, filed on Jun. 29, 2022, and the entire contents of which are incorporated herein by reference.

TECHNICAL FIELD

The present invention relates to the field of cups for making slushy drinks, and more particularly to a slushy cup capable of realizing quick heat exchange.

BACKGROUND

In summer, people are always enthusiastic about cold drinks, and a cup of slushy drink can help people forget hot feeling for a short time. The slushies may be acquired by shaving ice cubes into small slushies through an ice shaver. However, the slushies cannot be made by using the ice shaver in the case of no frozen ice cubes, and the ice shaver has a large volume and needs a large space for storage. In addition, it is also very troublesome to clean the ice shaver due to its large number of components, resulting in poor user experience.

SUMMARY

An objective of the present invention is to provide a slushy cup capable of realizing quick heat exchange. The cup is of a double-layer cup body structure, a refrigerant may be filled in an outer cup body, and a drink may be added in a frozen inner core of the cup, so that the drink in the inner core may be quickly cooled into a slushy drink by pressing the cup body, thereby quickly making the slushy drink. Further, compared with an ice shaver, the cup for making the slushy drink has a smaller structure and thus is easy to store.

In order to achieve the above objective, the present invention provides the following technical solutions.

A slushy cup capable of realizing quick heat exchange includes an inner core, an outer cup body sleeving the inner core and being abutted against the inner core, and a sealing connection sleeve sleeving the outer cup body and being detachably fitted to the inner core and the outer cup body respectively, wherein the sealing connection sleeve is used for sealing connection between the inner core and the outer cup body; the inner core includes a main body portion for containing a liquid drink, the main body portion is of a cup body structure with an opening in an upper part, and several convex ribs are distributed on a surface of an outer circumferential side wall of the main body portion; an interlayer is formed between an outer wall of the main body portion and an inner wall of the outer cup body for containing a refrigerant; and the inner core further includes an open portion protruding from a circumferential edge of a top surface of the main body portion and extending outward.

Further, a first sealing structure is disposed on an outer circumferential side wall of the open portion, a second sealing structure is disposed on an inner circumferential side wall of the sealing connection sleeve, and the second sealing structure matches the first sealing structure.

Further, the convex ribs include several mesh convex ribs distributed along an outer cylindrical surface of the main body portion in a staggered manner to increase a contact area of the inner core and the refrigerant.

Further, the first sealing structure includes several positioning protruding blocks disposed at a bottom connecting end of an outer side of the open portion; correspondingly, positioning through-holes matching the positioning protruding blocks in quantity and size are disposed at a rim of a mouth of the outer cup body, and the positioning protruding blocks extend into the positioning through-holes, for relative positioning of the inner core and the outer cup body.

Further, a third axial annular groove is disposed at a bottom of the rim of the mouth of the outer cup body, and the positioning through-hole is in communication with the third axial annular groove; correspondingly, a third axial annular fitting strip and a fourth axial annular groove are disposed at a lower end of an inner side of the sealing connection sleeve, a cup body outer rim of the outer cup body is fitted to the fourth axial annular groove, and the third axial annular fitting strip is fitted to the third axial annular groove.

Further, the first sealing structure further includes a first axial annular groove, the second sealing structure further includes a first axial annular fitting strip, and the first axial annular fitting strip cooperates with the first axial annular groove for sealing connection.

Further, the first sealing structure further includes a first radial annular groove; correspondingly, the second sealing structure further includes a first radial annular fitting strip; and the first radial annular fitting strip cooperates with the first radial annular groove for sealing connection.

Further, the first sealing structure further includes a second radial annular fitting strip, correspondingly, the second sealing structure is provided with a second radial annular groove, and the second radial annular fitting strip cooperates with the second radial annular groove for sealing connection.

Further, the convex ribs further include several radial convex ribs circumferentially distributed and axially fixedly connected to the outer circumferential side wall of the main body portion, and several radial annular convex ribs axially distributed and circumferentially fixedly connected to the outer circumferential side wall of the main body portion; and the radial convex ribs are perpendicularly intersected with and connected to the radial annular convex ribs, and the radial convex ribs and the radial annular convex ribs are all fixedly connected to outer sides of the mesh convex ribs.

Further, several notches are disposed on each of the radial annular convex ribs, and each of the notches is located on a convex rib section of the radial annular convex rib between the two radial convex ribs.

Further, the notch has a triangular shape.

Further, a protruding height of the open portion is one fifth to one third of the height of the inner core.

Further, the several mesh convex ribs may be distributed in a diamond, square or hexagon shape.

Further, an inner circumferential side wall of the open portion is an inclined surface extending outward from bottom to top, and an inner diameter of the inner circumferential side wall of the open portion is greater than an inner diameter of the main body portion.

Further, an inclination degree of a cup body of the main body portion is smaller than that of a cup body of the outer cup body.

Further, a width of the radial convex rib gradually decreases from top to bottom.

Further, an inclination degree of the inner circumferential side wall of the open portion is greater than the inclination degree of the main body portion.

It can be seen from the analysis that the present invention discloses the slushy cup capable of realizing quick heat exchange. The cup for making the slushy drink includes the outer cup body and the inner core. The outer cup body is connected to the outer side wall of the inner core in a sealing manner through the sealing connection sleeve, and may be detached for cleaning. The cup for making the slushy drink is of a double-layer cup structure, the refrigerant is placed in the interlayer between the inner core and the outer cup body, and the liquid drink is placed in the inner core. As the outer surface of the main body portion of the inner core and the convex ribs disposed on the outer surface of the main body portion of the inner core are in contact with the refrigerant, heat of the liquid in the inner core is quickly conducted to the refrigerant so as to achieve a cooling effect, and cold energy is transferred from the refrigerant to the drink in the inner core to suddenly reduce the temperature of the drink until the slushy drink is made. The outer cup body and the inner core of the cup for making the slushy drink are connected through the sealing connection sleeve, the first sealing structure is disposed at the bottom end of the open portion of the inner core, the second sealing structure is disposed on the inner side of the sealing connection sleeve, and positioning through-holes and axial grooves are correspondingly disposed at the rim of the outer cup body respectively, thereby separating the inner core from the outer cup body in a sealing manner. The sealing connection sleeve stores the refrigerant in the interlayer through multi-layer sealing, thereby effectively preventing the mixing of the liquid, such as the drink, and the refrigerant and avoiding the overflow of the refrigerant. The mesh convex ribs, the radial annular convex ribs and the radial convex ribs are disposed on the outer side of the inner core, thereby increasing the contact area for heat exchange and enhancing the strength of the outer wall of the inner core. Through full contact between the convex ribs on the outer surface of the inner core and the refrigerant, the cold energy of the refrigerant in the interlayer can be quickly conducted to the drink in the inner core, thereby quickly cooling the drink into the slushy drink.

With the adoption of the technical solutions of the present invention, the operation difficulty of making the slushy drink is lowered, the structural supporting strength is high, the cleaning time is greatly shortened and the working intensity is greatly reduced.

BRIEF DESCRIPTION OF THE DRAWINGS

The drawings described herein constituting a part of the present invention are provided for further understanding of the present invention, and the illustrative embodiments of the present invention and description thereof are used for explaining the present invention rather than unduly limiting the present invention. In the drawings.

Figure 1:
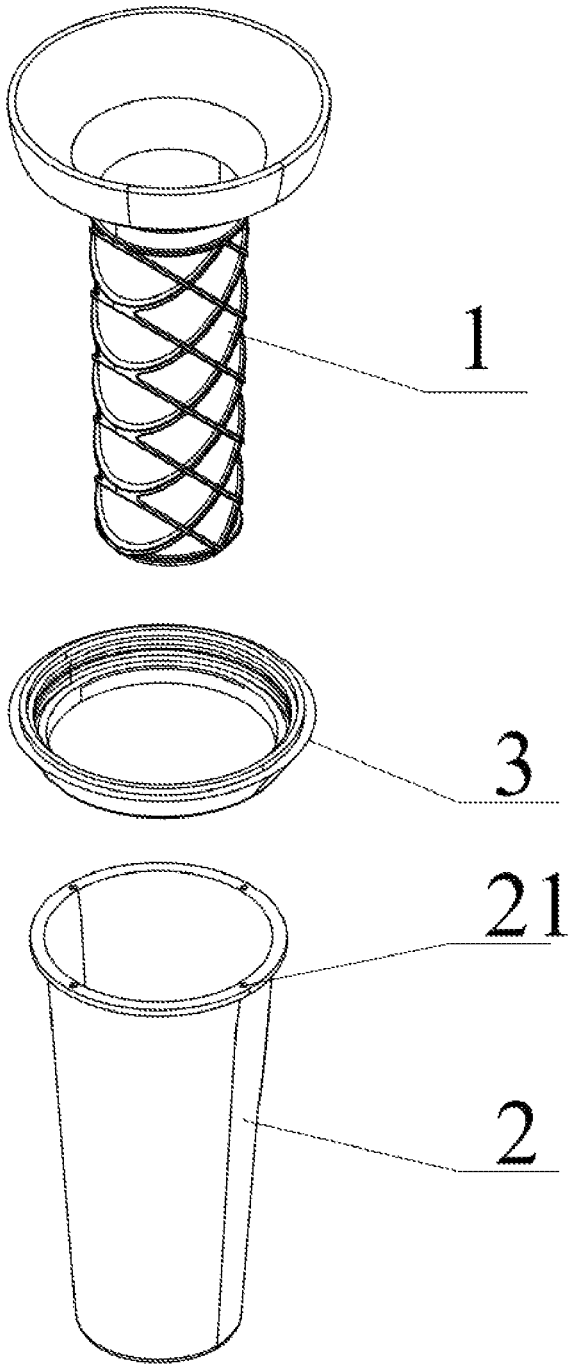
FIG. 1 is a schematic diagram of an exploded structure of an embodiment of the present invention.

References numerals of the drawings are described as follows:

1—inner core; 11—main body portion; 12—open portion; 13—convex rib; 131—mesh convex rib; 132—radial convex rib; 133—radial annular convex rib; 134—notch; 14—first sealing structure; 141—first axial annular groove; 142—first radial annular groove; 143—second radial annular fitting strip; 144—positioning protruding block;

2—outer cup body; 21—positioning through-hole; 22—third axial annular groove; 23—cup body outer rim;

3—sealing connection sleeve; 31—second sealing structure; 311—first axial annular fitting strip; 312—first radial annular fitting strip; 313—second radial annular groove; 314—third axial annular fitting strip; 315—fourth axial annular groove; and

4—interlayer.

DETAILED DESCRIPTION

The present invention will be described in detail below with reference to the accompanying drawings and in combination with the embodiments. Each embodiment is provided for explaining the present invention rather than limiting the present invention. In fact, it will be apparent to those skilled in the art that they may make modifications and variations to the present invention without departing from the scope or spirit of the present intention. For example, features illustrated or described as a part of one embodiment may be used in another embodiment to generate still another embodiment. Therefore, it is expected that the present invention includes such modifications and variations encompassed in the scope of the appended claims and equivalents thereof.

In the description of the present intention, orientation or position relationships indicated by terms such as "longitudinal", "transversal", "upper", "lower", "front", "rear", "left", "right", "vertical", "horizontal", "top" and "bottom" are based on the orientation or position relationships as shown in the drawings, only for ease of the description of the present invention rather than requiring that the present invention must be constructed and operated in a particular orientation. Therefore, these terms should not be understood as a limitation to the present invention. Terms "connect", "connection" and "dispose" used in the present invention shall be broadly understood. For example, the connection may be a fixed connection, or a detachable connection; may be a direct connection, or an indirect connection through an intermediate component; and may be a wired connection, a radio connection, or a wireless communication signal connection; and those of ordinary skills in the art may understand specific meanings of the above terms according to a specific situation.

One or more embodiments of the present invention are illustrated in the accompanying drawings. In the detailed description, reference numerals and alphabets are used to indicate features in the drawings. The same or similar reference numerals in the drawings and description are used to denote the same or similar parts in the present invention. As used herein, terms such as "first", "second" and "third" may be used interchangeably for distinguishing one component from another, and are not intended to indicate a position or importance of a separate component.

Embodiment 1

As shown in FIGS. 1-7, an embodiment of the present invention provides a slushy cup capable of realizing quick heat exchange. The cup for making the slushy drink includes an inner core 1, an outer cup body 2, and a sealing connection sleeve 3 for connecting the inner core 1 and the outer cup body 2 in a sealing manner. The outer cup body 2 sleeves the inner core 1, and the sealing connection sleeve 3 connects the outer cup body 2 to an outer wall of a cup mouth of the inner core 1. The inner core 1 is made of a food-grade silicone material and includes a main body portion 11. The main body portion 11 is of a cup body structure having an opening in an upper part for containing a liquid drink, and an inclination degree of a cup body of the main body portion 11 is smaller than that of a cup body of the outer cup body 2, thereby increasing a space between an inner wall of an upper part of the outer cup body 2 and an outer wall of the upper part of the main body portion 11. An open portion 12 is disposed above the main body portion 11, protrudes from a circumferential edge of a top surface of the main body portion 11, and extends outward, and a protruding height of the open portion 12 accounts for one fifth to one third of the height of the inner core 1, thereby preventing the drink in the inner core 1 from flowing out of the cup mouth due to volume expansion in the process of making the slushy drink. An inner circumferential side wall of the open portion 12 is an inclined surface extending outward from bottom to top, an inner diameter of the inner circumferential side wall of the open portion 12 is greater than an inner diameter of the main body portion 11, and an inclination degree of the inner circumferential side wall of the open portion 12 is greater than the inclination degree of the main body portion 11. Since it is required to manually and continuously press the cup in the process of making the slushy drink, an increase in the inner diameter of the inner circumferential side wall of the open portion 12 is advantageous in that the drink does not overflow even if a liquid level moves upward; and cold energy stored in the refrigerant is transferred to the drink through continuous pressing, upon the continuous pressing, the temperature of the drink gradually reduces and thus the liquid drink is changed to a slushy drink, and the slushy drink is prevented from flowing out of the cup even if the volume of the slushy drink continuously increases.

The main body portion 11 of the inner core 1 is placed in the outer cup body 2, an outer diameter of the main body portion 11 is smaller than an inner diameter of the outer cup body 2, and an interlayer 4 is formed between the outer wall of the main body portion 11 and the inner wall of the outer cup body 2, for containing the refrigerant.

In order to facilitate full contact between the inner core 1 and the refrigerant in the interlayer 4 and realize quick heat exchange, convex ribs 13 are disposed on an outer surface of the main body portion 11 of the inner core 1. The convex ribs 13 include several mesh convex ribs 131 distributed on an outer cylindrical surface of the main body portion 11 in a staggered manner, thereby increasing a contact area of the inner core 1 and the refrigerant and improving the heat conducting efficiency. In addition, the disposal of the convex ribs 13 may also enhance the structural supporting strength of the inner core 1.

In order to prevent the liquid in the inner core 1 from leaking into the refrigerant in the interlayer 4 of the outer cup body 2 and being mixed therewith in the process of making the slushy drink, an outer diameter of the open portion 12 of the inner core 1 is greater than the inner diameter of the outer cup body 2, and the sealing connection sleeve 3 connects a mouth of the outer cup body 2 to a lower end of the open portion 12 in a sealing manner. A specific sealing manner is as follows. A first sealing structure 14 is disposed on the outer circumferential side wall of the open portion 12 of the inner core 1, a second sealing structure 31 matching the first sealing structure 14 is disposed on an inner circumferential side wall of the sealing connection sleeve 3, and an inner diameter of a bottom of the sealing connection sleeve 3 is smaller than an outer diameter of the mouth of the outer cup body 2. The sealing connection sleeve 3 sleeves the outer cup body 2 from a lower part of the outer cup body 2, and connects the mouth of the outer cup body 2 to the outer side wall of the open portion 12 of the inner core 1 in a sealing manner through the cooperation of the first sealing structure 14 and the second sealing structure 31.

The first sealing structure 14 includes four positioning protruding blocks 144 disposed at a bottom end of the open portion 12. Correspondingly, four positioning through-holes 21 are disposed in a rim of the mouth of the outer cup body 2, and match the positioning protruding blocks 144 in size. When the positioning protruding blocks 144 and the positioning through-holes 21 cooperate with one another and are docked, positioning, cooperation and docking between the mouth of the outer cup body 2 and the bottom end of the open portion 12 are realized.

A third axial annular groove 22 is disposed at a bottom of the rim of the mouth of the outer cup body 2, and the positioning through-hole 21 is in communication with the third axial annular groove 22. Correspondingly, a third axial annular fitting strip 314 and a fourth axial annular groove 315 are disposed at a lower end of an inner side of the sealing connection sleeve 3, a cup body outer rim 23 of the outer cup body 2 is fitted into the fourth axial annular groove 315, and the third axial annular fitting strip 314 is fitted into the third axial annular groove 22, thereby realizing the sealing connection between the mouth of the outer cup body 2 and the sealing connection sleeve 3.

Figure 5:
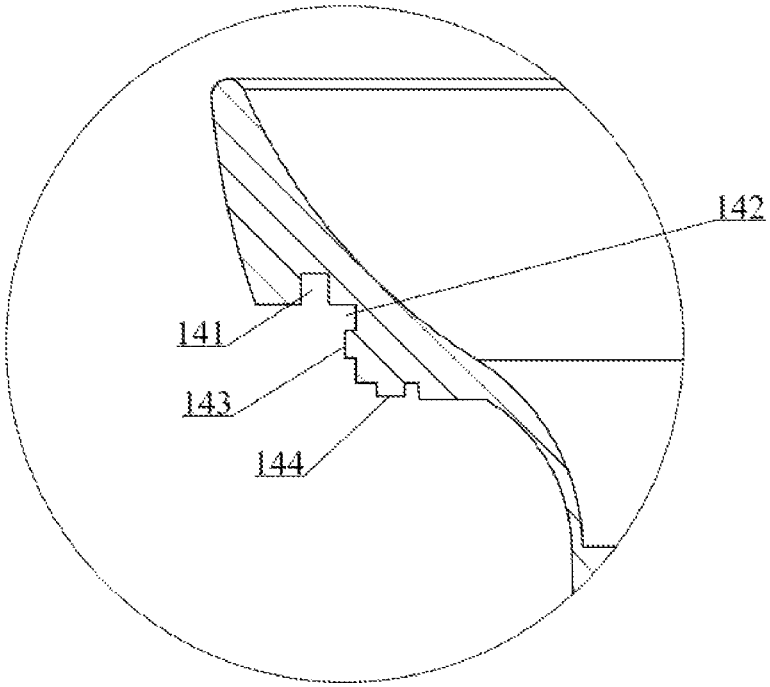
FIG. 5 is a schematic diagram of a partially enlarged structure in FIG. 4 according to an embodiment of the present invention.
Figure 6:
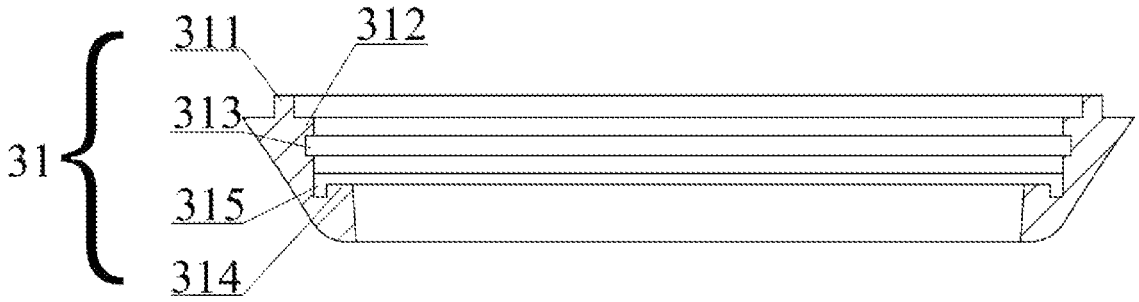
FIG. 6 is a schematic diagram of a sectional structure of a sealing connection sleeve according to an embodiment of the present invention.
Figure 7:
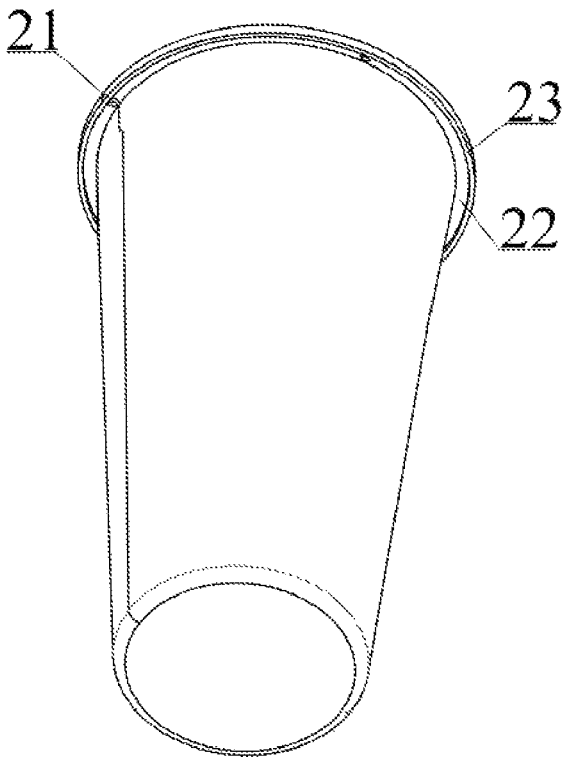
FIG. 7 is a schematic view of a three-dimensional structure of an outer cup body according to an embodiment of the present invention.

As shown in FIG. 5 and FIG. 6, the first sealing structure 14 includes a first axial annular groove 141 and a first radial annular groove 142, which are disposed one above the other. Correspondingly, the second sealing structure 31 is provided with a first axial annular fitting strip 311 and a first radial annular fitting strip 312 which correspond to the first axial annular groove 141 and the first radial annular groove 142, respectively.

In addition, a second radial annular fitting strip 143 is disposed below the first radial annular groove 142. Correspondingly, a second radial annular groove 313 is disposed below the first radial annular fitting strip 312, and the second radial annular fitting strip 143 cooperates with the second radial annular groove 313 for sealing connection. The first axial annular groove 141 is fitted to the first axial annular fitting strip 311, the first radial annular groove 142 is fitted to the first radial annular fitting strip 312, and the second radial annular fitting strip 143 is fitted to the second radial annular groove 313, thereby realizing the sealing connection between the sealing connection sleeve 3 and the lower end of the open portion 12 as well as sealing connection between the sealing connection sleeve 3 and the rim of the mouth of the outer cup body 2.

Embodiment 2

Figure 8:
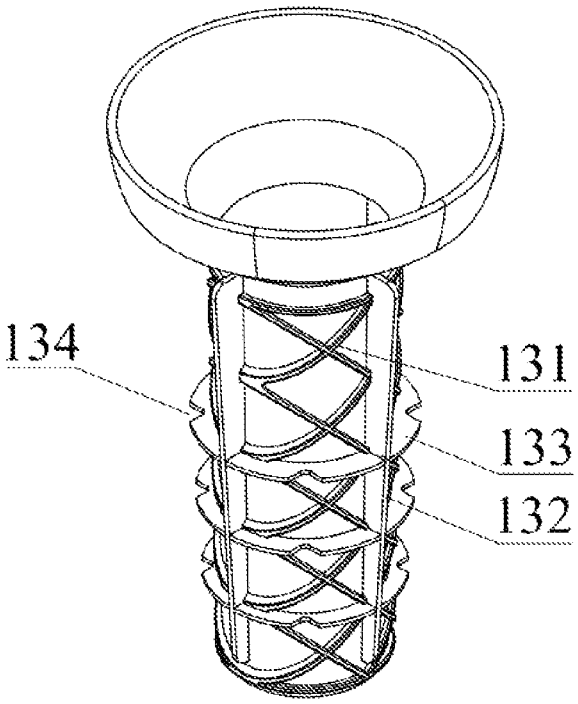
FIG. 8 is a schematic structural diagram of an inner core according to another embodiment of the present invention.

As shown in FIG. 8, the present invention further provides another convex rib structure of the inner core. The convex rib structure includes mesh convex ribs 131 circumferentially disposed on the main body portion 11 of the inner core 1, and four radial convex ribs 132 disposed at outer sides of the mesh convex ribs 131 and axially fixedly connected to the outer circumferential side wall of the main body portion 11. The four radial convex ribs 132 are circumferentially and uniformly distributed on the outer circumferential side wall of the main body portion 11, and the width of each radial convex rib 132 gradually decreases from top to bottom, so that the inner core 1 may extend into the bottom of the outer cup body 2. The radial convex ribs 132 can be attached to the outer circumferential side wall of the main body portion 11, so that quicker cold-heat exchange can be realized, and the cold energy has an excellent cooling effect.

The convex rib structure further includes three radial annular convex ribs 133 circumferentially fixedly connected to the outer circumferential side wall of the main body portion 11. The three radial annular convex ribs 133 are axially distributed along the outer circumferential side wall of the main body portion 11 at equal intervals, and the radial convex ribs 132 are perpendicularly intersected with the radial annular convex ribs 133, thereby increasing the contact area of the inner core 1 and the refrigerant and enhancing the overall supporting strength of the inner core 1.

In order to facilitate the smooth flow of the refrigerant in a space formed between the radial convex rib 132 and the radial annular convex rib 133, four notches 134 are disposed in each radial annular convex rib 133. Each notch 134 has a triangular shape, and is located on a convex rib section of the radial annular convex rib 133 between two radial convex ribs 132. When the slushy drink is made through pressing, the refrigerant may flow vertically through the notches 134, so that the temperature of the refrigerant in the upper and lower parts is uniform with no temperature difference.

Figure 2:
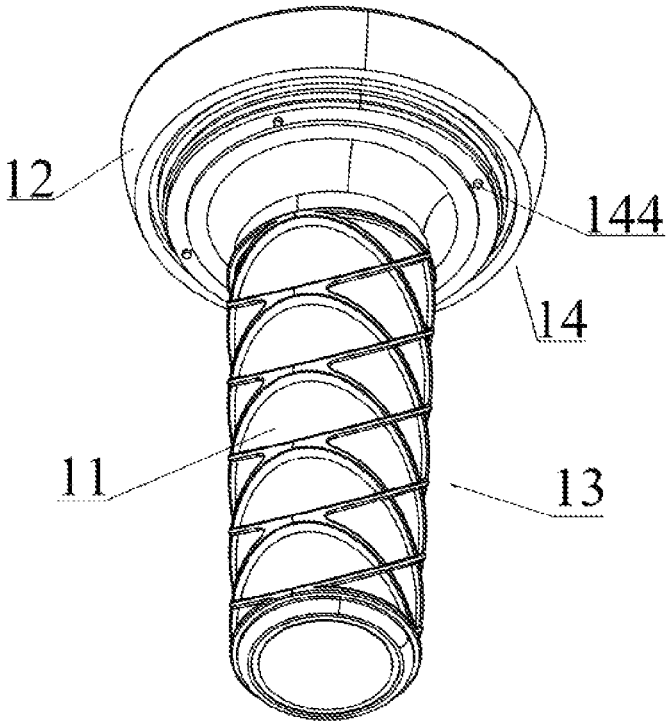
FIG. 2 is a schematic diagram of a three-dimensional structure of an inner core according to an embodiment of the present invention.
Figure 3:
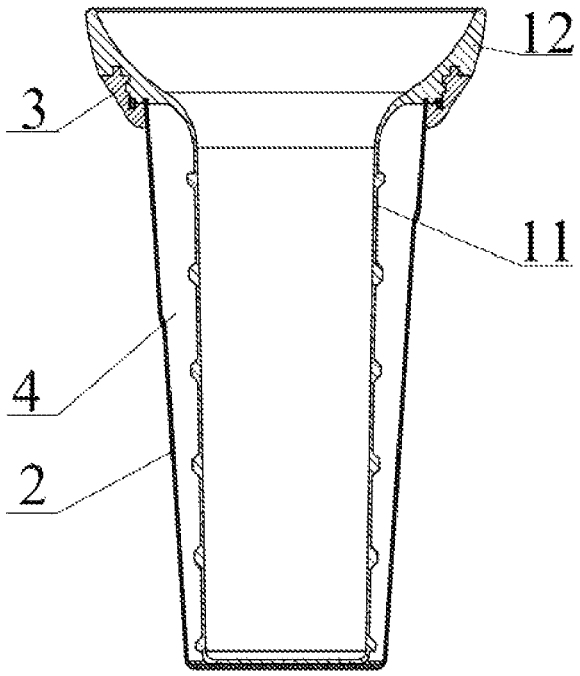
FIG. 3 is a schematic diagram of a sectional structure of an embodiment of the present invention.
Figure 4:
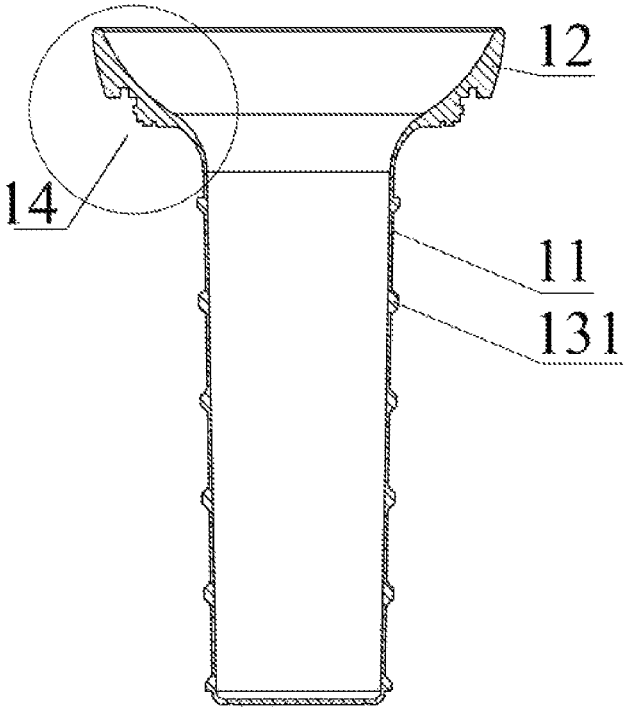
FIG. 4 is a schematic diagram of a sectional structure of an inner core according to an embodiment of the present invention.

As shown in FIG. 2, the mesh convex ribs 131 are intersected with one another to form a diamond shape. In addition, in order to achieve attractive appearance, the mesh convex ribs 131 may also be distributed in a square or hexagon shape. Since the description here is only a basic transformation of the figure shape with the same technical problem to be solved and the same technical effect to be achieved, no corresponding illustration will be given herein.

It can be seen from the above description that the above embodiments of the present invention achieve the following technical effects.

1. The cup for making the slushy drink is of the double-layer cup structure, the refrigerant is placed between the inner core 1 and the outer cup body 2, the liquid drink or the like is placed in the inner core 1, and the outer surface of the main body portion of the inner core 1 and the convex ribs 13 disposed on the outer surface of the main body portion of the inner core 1 are in contact with the refrigerant to quickly conduct heat of the liquid in the inner core 1 to the refrigerant so as to achieve the cooling effect. Thus, the slushy drink is made.
2. For the double-layer cup structure, the connection of double layers is achieved through the sealing connection sleeve 3, the first sealing structure is disposed at the bottom end of the open portion 12 of the inner core 1, the second sealing structure is disposed on the inner side of the sealing connection sleeve 3, and the positioning through-hole 21 and the third axial annular groove 22 are correspondingly disposed at the rim of the outer cup body, thereby separating the inner core 1 from the outer cup body 2 in a sealing manner, realizing the sealing at the mouth of the outer cup body 2, effectively preventing the mixing of the liquid, such as the drink, and the refrigerant, and avoiding the overflow of the refrigerant.
3. The mesh convex ribs 131, the radial annular convex ribs 133 and the radial convex ribs 132 are disposed at the outer side of the inner core 1, thereby increasing the contact area of the inner core 1 and the refrigerant and enhancing the structural supporting strength of the inner core 1.
4. The inner core 1 may be detached from the outer cup body 2, thereby achieving high convenience in cleaning.

Compared with the prior art, the slushy cup capable of realizing quick heat exchange according to the present invention has better scaling performance, is more durable, easy cleaning, and thus is more convenient and more practical.

The foregoing descriptions are merely preferred embodiments of the present invention, and are not intended to limit the present invention. Those skilled in the art may make various modifications and variations to the present invention. Any modifications, equivalent substitutions, improvements, and the like made within the spirit and principles of the present invention shall be within the protection scope of the present invention.

What is claimed is:

1. A slushy cup capable of realizing quick heat exchange, comprising:

an inner core (1), an outer cup body (2) sleeving the inner core (1) and being abutted against the inner core (1), and a sealing connection sleeve (3) sleeving the outer cup body (2) and being detachably fitted to the inner core (1) and the outer cup body (2) respectively, wherein the sealing connection sleeve (3) is used for sealing connection between the inner core (1) and the outer cup body (2);

the inner core (1) comprises a main body portion (11) for containing a liquid drink, wherein the main body portion (11) is of a cup body structure with an opening in an upper part, and several convex ribs (13) are distributed on a surface of an outer circumferential side wall of the main body portion (11); an interlayer (4) is formed between an outer wall of the main body portion (11) and an inner wall of the outer cup body (2) for containing a refrigerant; and the inner core (1) further comprises an open portion (12) protruding from a circumferential edge of a top surface of the main body portion (11) and extending outward;

a first sealing structure (14) is disposed on an outer circumferential side wall of the open portion (12);

the first sealing structure (14) comprises several positioning protruding blocks (144) disposed at a bottom connecting end of an outer side of the open portion (12); correspondingly, positioning through-holes (21) matching the positioning protruding blocks (144) in quantity and size are disposed at a rim of a mouth of the outer cup body (2); and the positioning protruding blocks (144) are docked with the positioning through-holes (21) for relative positioning of the inner core (1) and the outer cup body (2).

2. The slushy cup capable of realizing quick heat exchange according to claim 1, wherein a second sealing structure (31) is disposed on an inner circumferential side wall of the sealing connection sleeve (3), and the second sealing structure (31) matches the first sealing structure (14).

3. The slushy cup capable of realizing quick heat exchange according to claim 1, wherein the convex ribs (13) comprise several mesh convex ribs (131) distributed along an outer cylindrical surface of the main body portion (11) in a staggered manner to increase a contact area of the inner core (1) and the refrigerant.

4. The slushy cup capable of realizing quick heat exchange according to claim 1, wherein a third axial annular groove (22) is disposed at a bottom of the rim of the mouth of the outer cup body (2); correspondingly, a third axial annular fitting strip (314) and a fourth axial annular groove (315) are disposed at a lower end of an inner side of the sealing connection sleeve (3), a cup body outer rim (23) of the outer cup body (2) is fitted to the fourth axial annular groove (315), and the third axial annular fitting strip (314) is fitted to the third axial annular groove (22).

5. The slushy cup capable of realizing quick heat exchange according to claim 1, wherein the first sealing structure (14) further comprises a first axial annular groove (141), the second sealing structure (31) further comprises a first axial annular fitting strip (311), and the first axial annular fitting strip (311) cooperates with the first axial annular groove (141) for sealing connection.

6. The slushy cup capable of realizing quick heat exchange according to claim 5, wherein the first sealing structure (14) further comprises a first radial annular groove (142); correspondingly, the second sealing structure (31) further comprises a first radial annular fitting strip (312); and the first radial annular fitting strip (312) cooperates with the first radial annular groove (142) for sealing connection.

7. The slushy cup capable of realizing quick heat exchange according to claim 1, wherein the first sealing structure (14) further comprises a second radial annular fitting strip (143); correspondingly, the second sealing structure (31) is provided with a second radial annular groove (313); and the second radial annular fitting strip (143) cooperates with the second radial annular groove (313) for sealing connection.

8. The slushy cup capable of realizing quick heat exchange according to claim 1, wherein a protruding height of the open portion (12) is one fifth to one third of a height of the inner core (1).

9. The slushy cup capable of realizing quick heat exchange according to claim 3, wherein the several mesh convex ribs (131) are distributed in a diamond, square or hexagon shape.

10. The slushy cup capable of realizing quick heat exchange according to claim 1, wherein an inner circumferential side wall of the open portion (12) is an inclined surface extending outward from bottom to top, and an inner diameter of the inner circumferential side wall of the open portion (12) is greater than an inner diameter of the main body portion (11).

11. The slushy cup capable of realizing quick heat exchange according to claim 1, wherein an inclination degree of a cup body of the main body portion (11) is smaller than that of a cup body of the outer cup body (2).

12. The slushy cup capable of realizing quick heat exchange according to claim 10, wherein an inclination degree of the inner circumferential side wall of the open portion (12) is greater than an inclination degree of the main body portion (11).

13. A slushy cup capable of realizing quick heat exchange, comprising:

an inner core (1), an outer cup body (2) sleeving the inner core (1) and being abutted against the inner core (1), and a sealing connection sleeve (3) sleeving the outer cup body (2) and being detachably fitted to the inner core (1) and the outer cup body (2) respectively, wherein the sealing connection sleeve (3) is used for sealing connection between the inner core (1) and the outer cup body (2);

the inner core (1) comprises a main body portion (11) for containing a liquid drink, wherein the main body portion (11) is of a cup body structure with an opening in an upper part, and several convex ribs (13) are distributed on a surface of an outer circumferential side wall of the main body portion (11); an interlayer (4) is formed between an outer wall of the main body portion (11) and an inner wall of the outer cup body (2) for containing a refrigerant; and the inner core (1) further comprises an open portion (12) protruding from a circumferential edge of a top surface of the main body portion (11) and extending outward;

the convex ribs (13) comprise several mesh convex ribs (131) distributed along an outer cylindrical surface of the main body portion (11) in a staggered manner to increase a contact area of the inner core (1) and the refrigerant;

the convex ribs (13) further comprise several radial convex ribs (132) circumferentially distributed and axially fixedly connected to the outer circumferential side wall of the main body portion (11), and several radial annular convex ribs (133) axially distributed and circumferentially fixedly connected to the outer circumferential side wall of the main body portion (11); and the radial convex ribs (132) are perpendicularly intersected with and connected to the radial annular convex ribs (133), and the radial convex ribs (132) and the radial annular convex ribs (133) are all fixedly connected to outer sides of the mesh convex ribs (131).

14. The slushy cup capable of realizing quick heat exchange according to claim 13, wherein several notches (134) are disposed on each of the radial annular convex ribs (133), and each of the notches (134) is located on a convex rib section of the radial annular convex rib (133) between the two radial convex ribs (132).

15. The slushy cup capable of realizing quick heat exchange according to claim 14, wherein the notch (134) has a triangular shape.

16. The slushy cup capable of realizing quick heat exchange according to claim 13, wherein a width of the radial convex rib (132) gradually decreases from top to bottom.

* * * * *